United States Patent [19]

Duncan et al.

[11] 4,234,407

[45] Nov. 18, 1980

[54] REACTOR AND METHOD FOR HYDROCRACKING CARBONACEOUS MATERIAL

[75] Inventors: Dennis A. Duncan, Downers Grove; Justin L. Beeson, Clarendon Hills, both of Ill.; R. Donald Oberle, Hammond, Ind.; Henry A. Dirksen, Harvey, Ill.

[73] Assignee: The United States of America as represented by the United States Department of Energy, Washington, D.C.

[21] Appl. No.: 15,257

[22] Filed: Feb. 26, 1979

[51] Int. Cl.[3] ..... C10G 1/00; C10B 1/04

[52] U.S. Cl. ..... 208/8 R; 208/11 R; 202/121

[58] Field of Search ..... 202/121; 208/8 R, 11 R

[56] References Cited

U.S. PATENT DOCUMENTS

| | | | |
|---|---|---|---|
| 2,732,332 | 1/1956 | Geller | 202/121 X |
| 2,873,247 | 2/1959 | Borey | 202/121 X |
| 3,130,132 | 4/1964 | Sanders | 202/121 |
| 3,736,247 | 5/1973 | Jones, Jr. et al. | 208/11 R |
| 3,817,723 | 6/1974 | Doroth | 208/8 R X |
| 3,942,958 | 3/1976 | Thompson et al. | 48/213 |
| 4,021,298 | 5/1977 | Jones | 176/39 |
| 4,054,424 | 10/1977 | Standinger et al. | 48/210 |
| 4,075,079 | 2/1978 | Corg | 208/8 |
| 4,115,075 | 9/1978 | McMamee et al. | 208/8 |

OTHER PUBLICATIONS

Symposiums on "Structure and Reactivity of Coal and Char", and Symposiums on Indirect Liq. of Coal, vol. 20, No. 3, Aug. 24–29, 1975,presented at Chicago, Ill. ACS, 170th National Meeting F. C. Schora, Jr., Chairman and G. A. Mill program Chairman.

*Primary Examiner*—Delbert E. Gantz
*Assistant Examiner*—William G. Wright
*Attorney, Agent, or Firm*—James E. Denny; Richard G. Besha; Hugh W. Glenn

[57] ABSTRACT

Solid, carbonaceous material is cracked in the presence of hydrogen or other reducing gas to provide aliphatic and aromatic hydrocarbons of lower molecular weight for gaseous and liquid fuels. The carbonaceous material, such as coal, is entrained as finely divided particles in a flow of reducing gas and preheated to near the decomposition temperature of the high molecular weight polymers. Within the reactor, small quantities of oxygen containing gas are injected at a plurality of discrete points to burn corresponding amounts of the hydrogen or other fuel and elevate the mixture to high temperatures sufficient to decompose the high molecular weight, carbonaceous solids. Turbulent mixing at each injection point rapidly quenches the material to a more moderate bulk temperature. Additional quenching after the final injection point can be performed by direct contact with quench gas or oil. The reactions are carried out in the presence of a hydrogen-containing reducing gas at moderate to high pressure which stabilizes the products.

14 Claims, 6 Drawing Figures

REACTOR AND METHOD FOR HYDROCRACKING CARBONACEOUS MATERIAL

CONTRACTURAL ORIGIN OF THE INVENTION

The invention described herein was made in the course of, or under, a contract with the UNITED STATES DEPARTMENT OF ENERGY.

BACKGROUND OF THE INVENTION

The present invention relates to the hydrocracking of coal and other carbonaceous material. The materials contemplated include anthracite, bituminous and lignite coal, as well as peat, oil shale, tar sand, wood, lignin, solid petroleum residuals and other related materials. However, the development is particularly applicable to the conversion of lignite and bituminous coal to liquid and gaseous products.

The hydrocracking or hydropyrolysis of coal is the thermocracking of coal in the presence of hydrogen. Reaction temperatures and pressures are moderately high from 1400° to 1800° F. and from 1500 to 2500 psig. When solid coal particles are heated the volatile matter is released. The initial devolatilization appears to take place in two broad steps. In the first step moisture, carbon oxides, chemically formed water, tars and methane are released from a reactive semi-char. Upon further heating, semi-char is dehydrogenated to a less reactive char. The large flow of gases from the particles in the initial stages prevents hydrogen from entering the coal particles and diffusing to react with coal hydrocarbons. The materials emitted during coal pyrolysis diffuse into the bulk gas phase where reactions such as tar hydrogenation can take place.

Coal hydropyrolysis results in a pluralilty of hydrocarbon products including both aliphatic and aromatic compounds. Various products including alkanes as well as aromatics such as benzene, ethylbenzene, indenes, toluene, xylenes, phenols, napthalenes, and cresols may be included. It is important that the relative amounts of these various materials be controlled in a manner to accommodate the desired products. High octane materials for gasoline blending or feed stocks for chemical processing may make various product distributions desirable.

It has been found that process variables in the hydropyrolysis process can be altered to change product distributions. Changes in pressures, final reaction temperatures and high temperature histories are effective to produce variations in the relative amounts of the hydropyrolysis products. One method involving changes in the temperature profile is disclosed in the assignees co-pending application by Duncan, Ser. No. 15,258, filed Feb. 26, 1979, entitled "Process for Hydrocracking Carbonaceous Material to Provide Fuels or Chemical Feed Stock".

PRIOR ART STATEMENT

The following publications relate to the technical field of the subject invention but do not disclose or make obvious the invention as claimed.

Johnson, "Gasification of Montana Lignite in Hydrogen and in Helium During Initial Reaction Stages" *American Chemical Society Division of Fuel Chemistry Symposium on Structure and Reactivity of Coal in Char.* Chicago, Illinois 1975. This paper teaches the hydrocracking of lignite coal in the presence of hydrogen gas with an electrically heated reactor having independently controlled sections of the reactor coil. The process and reactor are illustrated in FIG. 1 of this report.

Duncan, et al, FE-2307-2, "Research and Development of Rapid Hydrogenation for Coal Conversion to Synthetic Motor Fuels", Task 1, USDOE-IGT 1976. This report describes a small scale experimental reactor having an electrically heated helical coil with independently controlled and monitored heating sections. The electrical and instrumentation for the reactor furnace is illustrated in FIG. 9, page 24.

SUMMARY OF THE INVENTION

Therefore, in view of the above it is an object of the present invention to provide a method of hydrocracking carbonaceous material that permits convenient temperature control with minimal use of external heat sources during high-temperature decomposition.

It is a further object to provide a method of coal hydropyrolysis in which coal particles are briefly exposed to high temperature for decomposition of high molecular weight material followed by rapid quenching.

It is also an object to provide a reactor adapted for the hydropyrolysis of carbonaceous materials at elevated temperatures and pressures.

In accordance with the present invention solid particles of carbonaceous material are cracked in the presence of a reducing gas into which the particles are entrained. A first quantity of oxygen containing gas is injected into the gas and solids flow at a temperature above the ignition temperature. The oxygen and the reducing gas react in a combustion zone to briefly raise the temperature of the carbonaceous particles flowing with the reacting gases to above their decomposition temperature. Turbulent gas flow somewhat quenches the gas and particles of highest temperature to near the bulk temperature. Subsequently a second quantity of oxygen containing gas is injected into the gas and solids flow to again produce a combustion zone in which carbonaceous particles are heated to decompose high molecular weight material to hydrocarbon products.

In more specific aspects of the invention, the stoichiometric quantity of oxygen containing gas injected in each of the injection steps is substantially less than the corresponding stoichiometric amount of reducing gas into which it is injected. This produces a region of radiant heat transfer within the combustion zone where the particles of carbonaceous material are subjected to a first temperature substantially in excess of the resulting bulk temperature. Turbulent flow within the combustion zone results in rapid quenching of the particles to the bulk temperature at that point in the reactor.

In other aspects a flow of inert or other gas at a temperature less than the bulk temperature is injected into the turbulent gas flow at a point subsequent in flow to all of the oxygen injection steps to provide quench to a temperature below the dehydroxylation and dealkalization temperatures of the various products. Another quenching technique involves the direct contact of the gas flow with a liquid quench oil that also can be used to preheat the solid carbonaceous feed.

The invention also contemplates a reactor for hydrocracking solid carbonaceous material to provide gaseous and liquid fuels. The reactor includes a reactor tube capable of passing a flow of carbonaceous solids entrained in a reducing gas. The reactor tube is provided with a first injection tube with its outlet positioned to discharge an oxygen containing gas into the flow of carbonaceous solids and gas. A second injection tube has its outlet disposed within the reactor tube down flow of the first injection tube outlet for providing an additional flow of oxygen containing gas into the reactor tube. In more specific aspects an opening or other means for bleeding an inert or other coolant gas into the reactor tube down flow of each of the injection points is provided to quench the reactor discharge flow.

BRIEF DESCRIPTION OF THE DRAWINGS

The present invention is illustrated in the accompanying drawings wherein.

DETAILED DESCRIPTION OF THE PREFERRED EMBODIMENT

Figure 1:
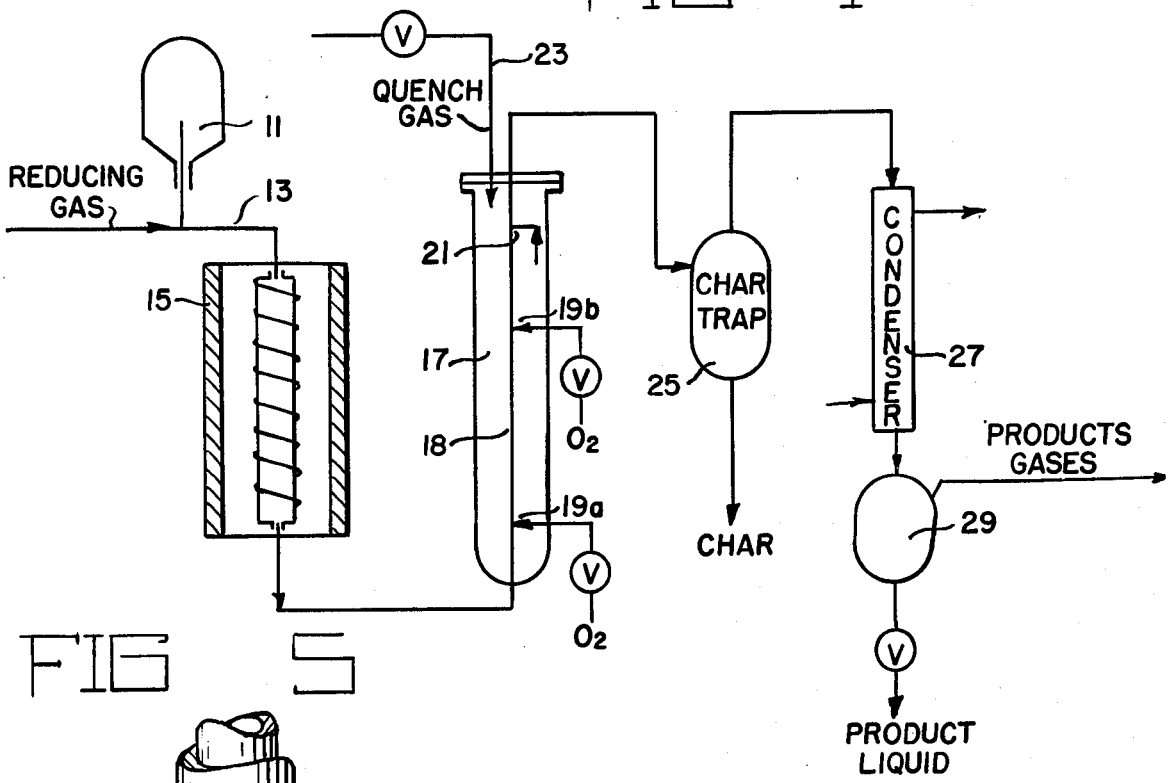
FIG. 1 is a flow diagram for a hydropyrolysis process for carbonaceous material.

In the process of FIG. 1, feed coal or other solid carbonaceous material from a supply hopper 11 is entrained into the flow of hydrogen or other reducing gas illustrated as in line 13 and the combined flow passed through a suitable preheater 15. The solid gas mixture is preheated to a sufficiently high temperature eg. 800°–1200° F. to ignite the oxygen-coal-hydrogen mixture to be formed in the reactor as will be described below. At the lower temperatures within this range, the coal may ignite first to raise the temperature to the hydrogen-oxygen ignition level.

The reducing gas is a hydrogen containing gas or a gas having components which will react to produce hydrogen. For example hydrogen gas, hydrogen and an inert diluent gas, synthesis gas from coal gasification including carbon monoxide and hydrogen, or a mixture of steam and carbon monoxide are contemplated.

The preheated flow of entrained carbonaceous material is illustrated entering the hydropyrolysis reactor 17 at its lower end. Within reactor 17 controlled quantities of oxygen containing gas are injected into the flow of reducing gas and carbonaceous material at a plurality of injection points 19*a* and 19*b* along the reactor length. Although only two injection points are illustrated, any number of such points can be used to obtain a desired hydropyrolysis temperature or time-temperature profile during the hydrocracking reaction.

The oxygen containing gas introduced at these points can be air, air enriched in oxygen, oxygen gas or other suitable mixtures of oxygen and an inert diluent gas. The injected oxygen reacts with the hydrogen or other reducing gas, product gases or the solid carbonaceous materials to increase the reactor temperature by a controlled amount depending upon the amount of oxygen introduced.

Only relatively small stoichiometric amounts of oxygen in respect to the reducing gas are introduced at each injection point. This creates combustion zones adjacent to each injection point that will include an internal region of radiant heat transfer where the particles of carbonaceous material are subjected to a very high temperature. The temperature in these internal regions are substantially in excess of the bulk temperature down flow of the combustion zone. It is expected that the stoichiometric quantity of oxygen within the oxygen containing gas injected at any point will be less than 1/5 the stoichiometric quantity of reducing gas flow at that injection point and typically about 3 to 5% of the reducing gas flow.

Turbulent flow conditions within the reactor tube will rapidly quench the material within the internal region of radiant heat transfer to the bulk temperature. As an example, final bulk temperatures of the reducing gas, product gas and remaining carbonaceous particles down flow of the final oxygen injection point will be on the order of 1400°–1600° F., with temperatures in excess of 1600° F. in the internal regions of radiant heat transfer near where the oxygen containing gas is injected. However, in some instances bulk temperatures up to 1800° F. may be desirable with correspondingly increased temperatures within the internal regions.

In one manner of quenching the products and residual material leaving the reactor, a bleed of quench gas can be introduced into the reactor tube as illustrated at point 21 in FIG. 1. The quench gas bleeds into the reactor tube 18 from the gas pressure within the internal volume of the reactor 17. The flow of quench gas can be controlled as through valved line 23 into the reactor shell.

Any suitable quench gas which will not interfere with the process performance can be selected. An inert gas such as nitrogen can be selected where the dilution of product is not a major concern and where it is desirable to maintain a noncombustible gas within the reactor shell. Alternatively, cooled and recycled hydrogen or product gas can be used as a quench.

It will be understood that the introduction of a quench gas is only one means of reducing the bulk temperature of the gas flow to below the temperature at which substantial molecular fragmentation occurs. Other methods such as a direct-contact oil quench, (FIG. 6) or an indirect contact heat exchange for the recovery of process heat can be used. Rapid or programmed quenching to below the hydrocracking temperatures is of considerable importance in controlling the distribution of product species. These considerations are more thoroughly discussed in Assignees' co-pending Application entitled "Process for Hydrocracking Carbonaceous Material to Provide Fuel or Chemical Feed Stock", S-50,975 cited above.

The product gases and entrained solids pass from reactor 17 through a char trap 25 where the spent char is disentrained from the gas and collected as a dry powder. The effluent gases from the char trap 25 are next cooled and partially condensed by indirect heat exchange in such a condenser 27 before entering the gas liquid separator 29. The product gases from separator 29 can be further condensed and dried at low temperatures to wring out remaining condensable hydrocarbons. A portion of the remaining gas enriched in hydrogen or other reducing gas is recycled as carrier gas for entraining the solid carbonaceous material. The product liquids from separator 29 can be fractionated by distillation into gas, gasoline, distillate and fuel oil fractions by conventional methods. Portions of these liquid streams can be recycled for slurrying the solid carbonaceous material or for heat exchange purposes.

Figure 2:
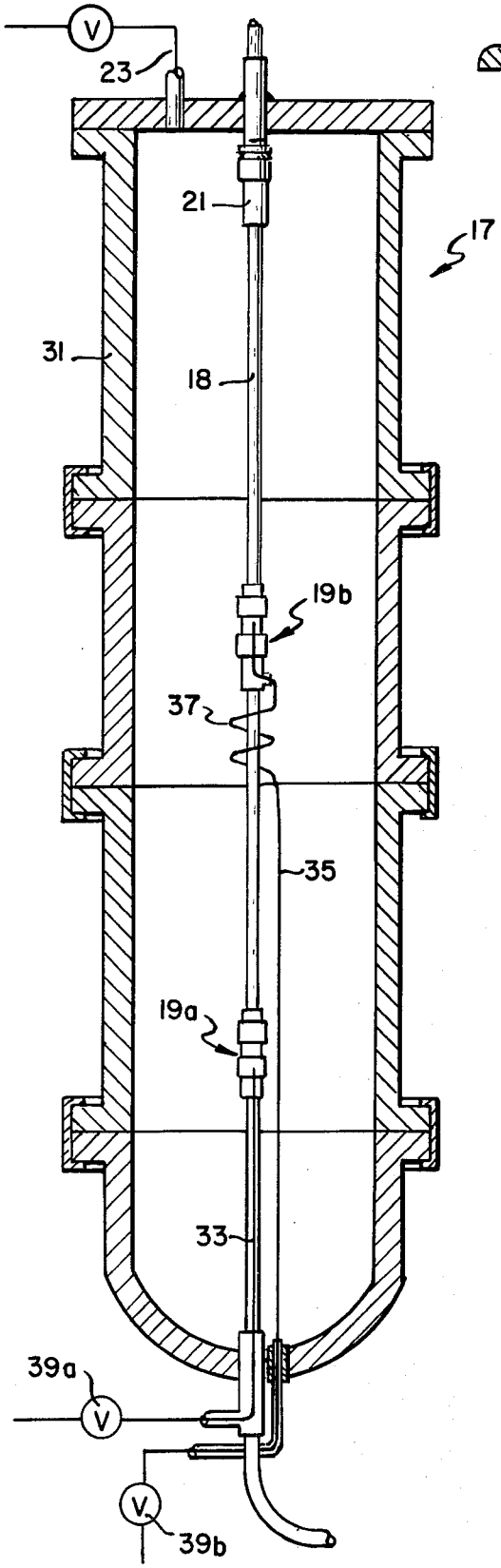
FIG. 2 is a cross-sectional elevation view of the hydropyrolysis reactor.

Turning now to FIG. 2, one design of a hydropyrolysis reactor is illustrated. The reactor includes an outer pressure shell 31 concentrically containing the reactor tube 18. Shell 31 is provided with a valved inlet 23 for maintaining a sufficiently high pressure of quench gas within the shell to balance the pressures generated within reactor tube 18. The pressure is sufficiently high to provide a flow of quench gas into the the reactor tube at bleed point 21. This "balanced pressure" design is of particular value in a small scale hydropryolysis reactor. A reactor of increased size for commercial use can be provided with an errosion resistant refractory liner supported within a steel shell capable of withstanding the stresses imposed by the operating pressure of the system.

The oxygen containing gas introduced at injection points 19*a* and 19*b* is transported through relatively small diameter tubes 33 and 35. The oxygen containing gas for injection point 19*a* is provided by tube 33 which is positioned concentrically within reactor tube 18 from outside the reactor shell 31. A second tube 35 penetrates shell 31 and extends along the outside of reactor tube 18 to injection point 19*b* where it enters the reactor tube. Coils 37 are illustrated in tube 35 to accommodate thermal expansion and contraction. It will be clear that either of these techniques for providing oxygen containing gas at the injection points as well as other methods known to the artisan can be employed in reactors having more than the two points for oxygen injection.

The flow of oxygen containing gas to the injection points 19*a* and 19*b* can be controlled by suitable process components such as valves 39*a* and 39*b* to control the temperatures at each injection point along the reactor tube. The controlled injection of oxygen also can be used to control the final bulk temperature in the upper end portion of reactor tube 18.

Figure 3:
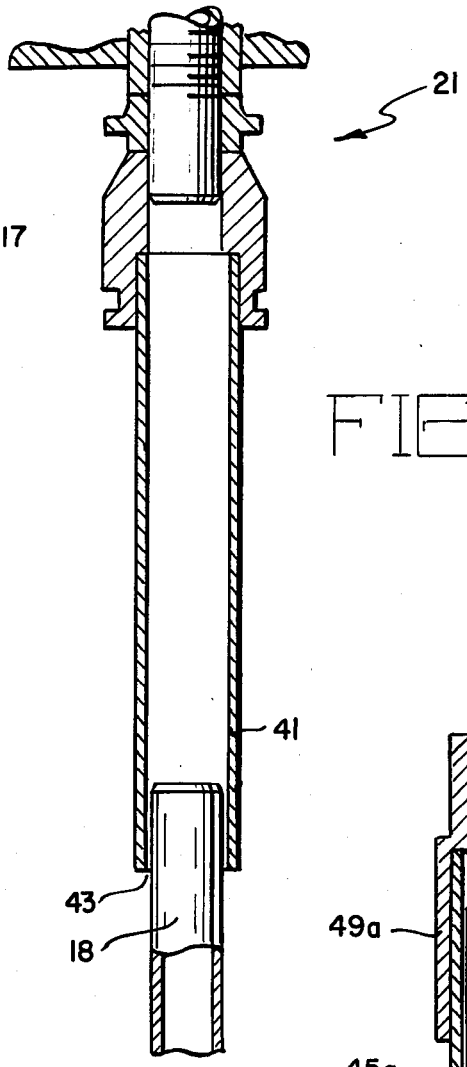

Additional details of the bleed point 21 for the quench gas are illustrated in FIG. 3 where a slightly oversized slip tube 41 fits over the end portion of reactor tube 18 or an appropriately fitted end portion thereon. A small gap or bleed opening 43 is thereby created around the outside upper portion of the reactor tube within slip tube 41 to permit passage of a flow of quench gas. The flow of quench gas not only reduces the bulk temperature of the gas flow but also prevents leakage of combustible gases into the volume of reactor shell 31. As is apparent, the slip tube connection also provides for the thermal expansion and contraction of reactor tube 18.

Figure 5:
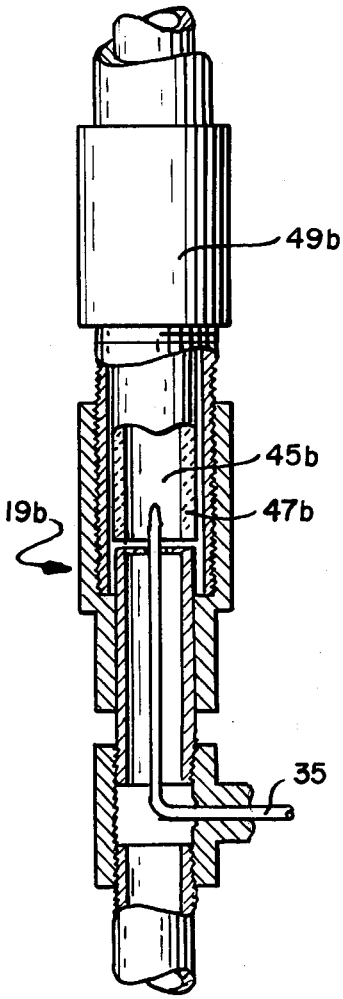
FIGS. 3, 4 and 5 are enlarged details in cross-section of components within the reactor in FIG. 2.
Figure 4:
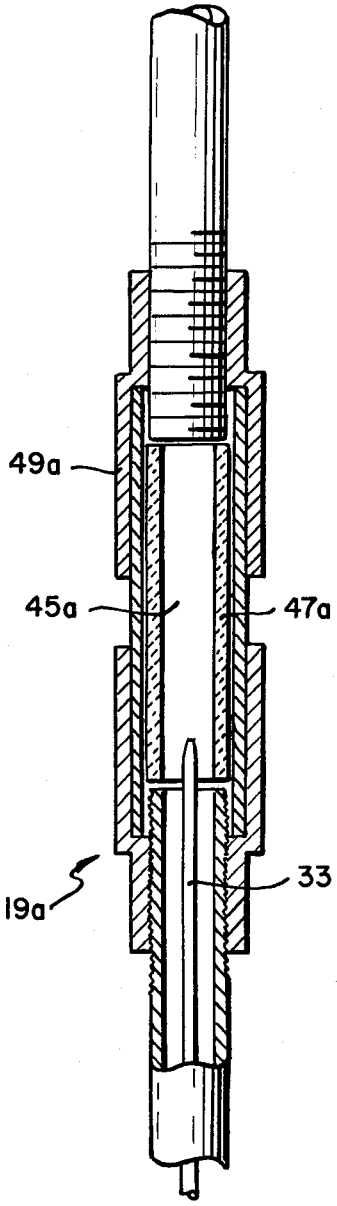

FIGS. 4 and 5 give further details illustrating the injection points at 19*a* and 19*b* where the combustion zones are established. At both points 19*a* and 19*b* the oxygen tubes 33 and 35 are illustrated as terminating where they are coaxially aligned along the length of the reactor tube in the direction of the gas flow. The combustion zones 45*a* and 45*b* thus established are contained within refractory or ceramic linings 47*a* and 47*b* fitted in appropriate inserts or unions 49*a* and 49*b* within the reactor tube 18.

Figure 6:
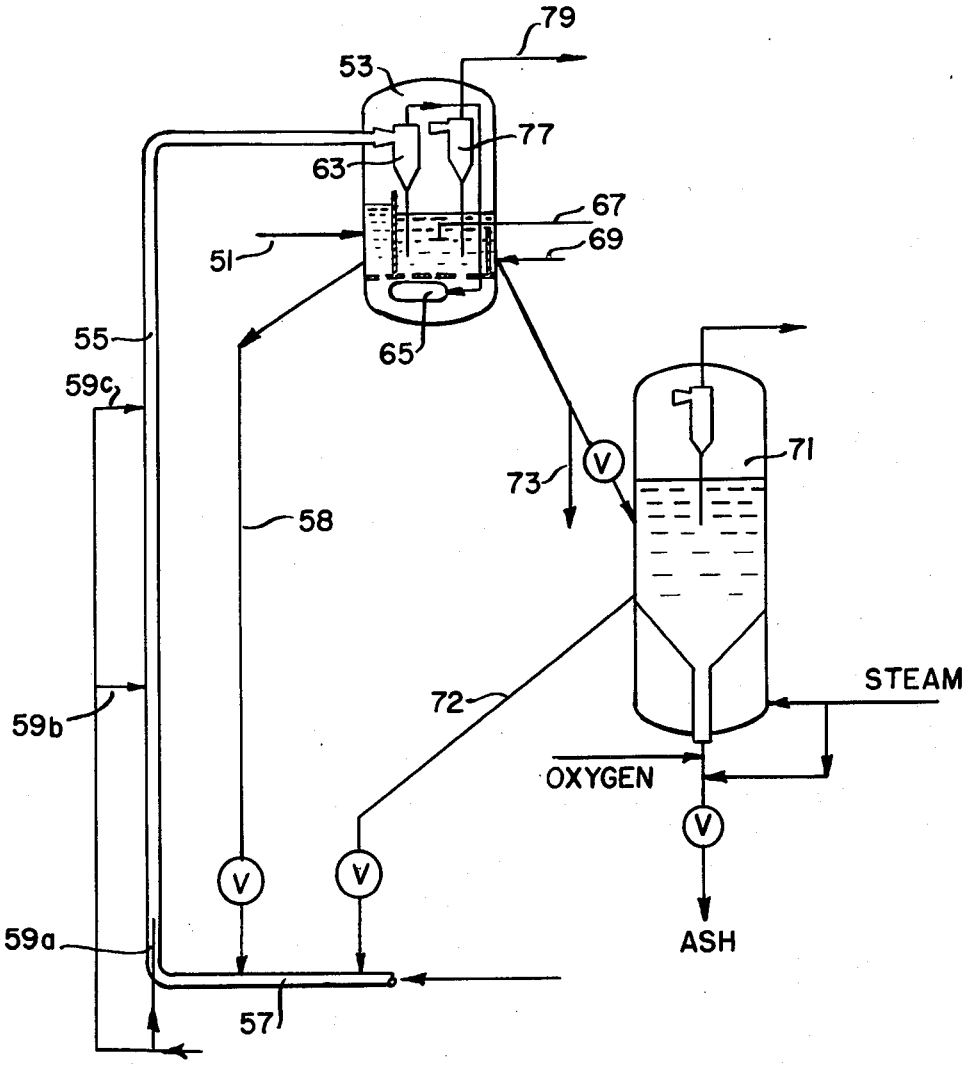
FIG. 6 is a flow diagram of an alternate hydropryolysis process and system.

An alternate process design that may be more suitable for a commercial scale hydropyrolsis process is illustrated in FIG. 6. In this process pulverized coal or other carbonaceous material is slurried with recycled oil in line 51 and fed into a slurry-drying section of a disengagement and quench vessel 53. In this vessel the coal feed is dried while acting as a heat sink to quench the reaction product gases. The hot product gases from reactor 55 help to fluidize the bed of coal within the quench vessel 53.

Dried coal from the quench vessel is passed via line 58 into line 57 for entrainment within a stream of preheated hydrogen or other reductant gas (eg. at 15 to 60 ft/sec.). The resulting gas and solids are passed to reactor tube 55 where oxygen containing gas is appropriately injected at points 59*a*, 59*b*, and 59*c*. The oxygen reacts with the reductant gases or other combustibles to provide the high temperatures needed for the cracking of the solid carbonaceous material.

The hot product stream from the hydrocracking reactor 55 enters a cyclone separator 63 within the quenching vessel 53 where the char is separated from the product vapor stream. The gas stream from cyclone separator 63 is injected into the quench vessel lower portion through a distributor grid 65. This lower quench section of vessel 53 thus contains a fluidized bed of char into which recycled quench oil at 67 is added. Stripping steam also is provided as illustrated at 69 to further strip the fluidized char of hydrocarbon gases and condensable products.

The steam stripped char is transferred to a char gasifier 71 or withdrawn for use as desulfurized fuel at 73. Gasifier 71 is suitably provided with a flow of steam and oxygen containing gas for the complete gasification of the char. Char from the gasifier can be recycled to the reactor through line 72 for startup, additional conversion or heat recovery.

The product vapors and revaporized slurry within quench vessel 53 proceed through a final cyclone separator 77 for gas-solid separation. The overhead gas stream 79 from separator 77 passes to condensation and heat recovery processes (not shown). The remaining noncondensable gases are enriched in hydrogen or other reducing gas and recycled back as the carrier for the carbonaceous material through the hydropyrolysis reactor 55.

The liquids condensed from the product gas stream 79 from the quench vessel 53 are fractionated after recovery of pressure energy from the flow. This liquid product is separated into gas, gasoline, distillate and fuel oil fractions by conventional methods. A portion of the distillate or other streams can be stored for subsequent recycling as slurry or quench oil.

The amount of carrier hydrogen or other reducing gas used in the reactor is limited to avoid heavy dilution of the products and to minimize equipment size. The range of hydrogen to coal contemplated is about 10 to 40 weight percent in respect to the coal on a moisture and ash free basis. Reactor pressures of about 1500 to 2500 psig provide suitable hydrogen partial pressure for hydrocracking in reactors operating at temperatures of 1400° F. to 1800° F. and residence times of 1 to 5 seconds.

It is therefore seen that the present invention provides a process for the hydrocracking of carbonaceous material in which heat for thermal decomposition is provided by combustion of materials within the process. Temperature control can thus be obtained by regulating the injection of oxygen for combustion. Regions of high temperature are thereby established within the combustion zone near the oxygen injection points followed by rapid quenching to the bulk temperature of the material flowing through the reactor. An uncomplicated reactor design for performing this hydrocracking process is also provided.

It will be clear that various changes in the materials, process units and other components disclosed in presenting the present invention can be made by those skilled in the art within the scope of the claims The embodiments of the invention in which an exclusive property or privilege is claimed are defined as follows:

1. A method of cracking solid carbonaceous material in the presence of a reducing gas containing hydrogen comprising:

entraining said carbonaceous material as particles in the reducing gas containing hydrogen to form a cocurrent flow of gas and carbonaceous solids;

preheating said cocurrent flow to a temperature of at least 800° F.;

injecting a first quantity of oxygen containing gas into the cocurrent flow at a temperature above the ignition temperature of the resulting mixture to react within a combustion zone to raise the temperature of the carbonaceous particles to above their decomposition temperature and form hydrocarbon products;

injecting at least a second quantity of oxygen containing gas into the cocurrent flow at a location down-flow of said first injection to again produce at least another combustion zone and a cocurrent flow temperature of about 1400°–1800° F. at a pressure of about 1500–2500 psig to decompose and hydrogenate carbonaceous material to form hydrocarbon products;

quenching the cocurrent flow of gas and solids to below the temperature at which dehydroxylation and dealkylation of aromatics proceeds toward increasing benzene concentration; and recovering the hydrocarbon products from the process.

2. The method of claim 1 wherein said gas flow is quenched by direct contact with a liquid oil and heat is transferred from said liquid oil by direct contact with said carbonaceous material subsequently entrained in said reducing gas.

3. The method of claim 1 wherein said flow of gases is quenched to below about 1200° F.

4. The method claim 1 wherein said flow of gas and solids is in turbulent state during and after each injection of oxygen containing gas.

5. The method of claim 1 wherein the stoichiometric quantity of oxygen in each of said injection steps being less than one fifth that required to react with all of the reducing gas flow into which it is injected to produce a region of radiant heat transfer within said combustion zone wherein said particles of carbonaceous material are subjected to a first temperature substantially in excess of the bulk temperature down flow of said combustion zone and are quenched to that bulk temperature by turbulent mixing within the reactor tube.

6. The method of claim 1 wherein said cocurrent flow is at a pressure of about 1500–2500 psig and a temperature of about 1400° F. to 1800° F. for a residence time of about 1 to 5 seconds.

7. The method of claim 1 wherein said oxygen containing gas consists of a gas selected from the group consisting of oxygen, air, oxygen with inert diluent gas and mixtures thereof.

8. The method of claim 4 wherein a gas that will not chemically react with the carbonaceous material or reducing gas is injected into the turbulent gas flow at a point subsequent in flow to all of said injections of oxygen containing gas to quench the turbulent gas flow.

9. The method of claim 5 wherein particles of carbonaceous material within said region of radiant heat transfer are subjected to temperatures in excess of 1600° F.

10. A reactor for hydrocracking solid carbonaceous material to produce gaseous and liquid products of reduced molecular weight comprising:

means for entraining particles of solid carbonaceous material in a flow of reducing gas;

a reactor tube having an inlet and an outlet capable of passing the flow of carbonaceous solids entrained in reducing gas;

a first injection tube having its outlet aligned coaxially within and towards said outlet of the reactor tube to discharge an oxygen-containing gas into the flow of carbonaceous solids entrained in gas, a second injection tube having its outlet aligned coaxially within and towards said outlet of the reactor tube down-flow of the first injection tube outlet to discharge oxygen containing gas into the flow of carbonaceous solids entrained in gas; and means communicating with the reactor tube outlet for temperature quenching the flow of solids entrained in gas.

11. The reactor of claim 10 wherein a ceramic lining is provided within the reactor tube at the discharge of each of the injection tubes to establish a high-temperature combustion zone.

12. The reactor of claim 10 wherein said means for quenching said flow of solids entrained in gas comprises a vessel containing a liquid quench oil, said vessel having an inlet connected to the reactor tube for receiving said products as gases into contact with said liquid oil, an inlet for receiving solid carbonaceous material into said vessel into intimate contact with said liquid oil and means interconnecting said vessel with the inlet of said reactor tube for conveying said solid carbonaceous material entrained in gas, into said reactor tube, to permit heat transfer from said products to said solid carbonaceous materials.

13. The reactor of claim 10 wherein means for bleeding a quench gas into said reactor tube down flow of each of the injection tube outlets is provided to quench the flow of solids entrained in gas.

14. The reactor of claim 13 wherein said quench gas bleed means comprises a pressure enclosure containing inert gas at a pressure slightly in excess of the pressure within and along the length of the reactor tube and a constricted opening within the reactor tube for admitting a bleed of said inert gas.

* * * * *